US009865279B2

(12) United States Patent
Amada et al.

(10) Patent No.: US 9,865,279 B2
(45) Date of Patent: Jan. 9, 2018

(54) METHOD AND ELECTRONIC DEVICE

(71) Applicant: Kabushiki Kaisha Toshiba, Minato-ku, Tokyo (JP)

(72) Inventors: Tadashi Amada, Ome Tokyo (JP); Hirokazu Takeuchi, Machida Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 15/050,188

(22) Filed: Feb. 22, 2016

(65) Prior Publication Data

US 2016/0210983 A1 Jul. 21, 2016

Related U.S. Application Data

(63) Continuation of application No. PCT/JP2013/084976, filed on Dec. 26, 2013.

(51) Int. Cl.
*G10L 21/02* (2013.01)
*G10L 21/034* (2013.01)
(Continued)

(52) U.S. Cl.
CPC ..... *G10L 21/034* (2013.01); *G10L 21/028* (2013.01); *G10L 21/0316* (2013.01);
(Continued)

(58) Field of Classification Search
CPC . G10L 21/02; G10L 21/0208; G10L 21/0216; G10L 21/0272; G10L 21/028;
(Continued)

(56) References Cited

U.S. PATENT DOCUMENTS 6,311,155 B1 * 10/2001 Vaudrey ..... G11B 20/00992 381/10
8,731,915 B2 * 5/2014 Shin ..... H03G 3/32 704/225
(Continued)

FOREIGN PATENT DOCUMENTS

JP 2003-259245 A 9/2003
JP 2003-280696 A 10/2003
(Continued)

OTHER PUBLICATIONS

Notification for Reasons of Refusal mailed by Japan Patent Office dated Oct. 4, 2016 in the corresponding Japanese patent application No. 2015-554416—6 pages.
(Continued)

*Primary Examiner* — Qi Han
(74) *Attorney, Agent, or Firm* — Knobbe, Martens, Olson & Bear, LLP

(57) ABSTRACT

According to one embodiment, a method performed by an electronic device includes: receiving an audio signal comprising voice and background sound via a microphone; receiving a user's operation to set a loudness of the voice or the background sound; setting a balance between a first gain of the voice and a second gain of the background sound according to the user's operation; separating the input audio signal into a first signal of the voice and a second signal of the background sound; amplifying the first signal according to the first gain; amplifying the second signal according to the second gain; and outputting the first signal and the second signal at least partially overlapping each other via a speaker.

8 Claims, 10 Drawing Sheets

(51) Int. Cl.

| | |
|---|---|
| ***G10L 21/0316*** | (2013.01) |
| ***G10L 21/028*** | (2013.01) |
| ***H04R 3/04*** | (2006.01) |
| *H04R 5/04* | (2006.01) |

(52) U.S. Cl.
CPC ..... *H04R 3/04* (2013.01); *H04R 5/04* (2013.01); *H04R 2430/01* (2013.01); *H04R 2430/03* (2013.01); *H04R 2499/11* (2013.01); *H04R 2499/15* (2013.01)

(58) Field of Classification Search
CPC ..... G10L 21/0308; G10L 21/0316; G10L 21/034; G10L 19/02; G10L 19/022; G10L 19/26; G10L 19/265; G10L 25/78; G10L 25/81; G10L 25/84; G10L 25/93
USPC ..... 704/225, 206, 226, 276, 278
See application file for complete search history.

(56) References Cited

U.S. PATENT DOCUMENTS

| | | | | |
|---|---|---|---|---|
| 2005/0015252 | A1* | 1/2005 | Marumoto | G10L 21/02 704/234 |
| 2011/0181789 | A1 | 7/2011 | Nishimura | |
| 2013/0035933 | A1 | 2/2013 | Hirohata | |
| 2013/0163775 | A1* | 6/2013 | Yamkovoy | G10K 11/1782 381/71.6 |

FOREIGN PATENT DOCUMENTS

| | | | |
|---|---|---|---|
| JP | 2004-289614 | A | 10/2004 |
| JP | 2007-336210 | A | 12/2007 |
| JP | 2010-054728 | A | 3/2010 |
| JP | 2011-155541 | A | 8/2011 |
| JP | 2013-050604 | A | 3/2013 |

OTHER PUBLICATIONS

Steven F. Boll, "Suppression of Acoustic Noise in Speech Using Spectral Subtraction," IEEE Transactions of Acoustics, Speech and Signal Processing, vol. ASSP-27, No. 2, pp. 113-120, Apr. 1979.

Yariv Ephraim et al., "Speech Enhancement Using a Minimum Mean-Square Error Short-Time Spectral Amplitude Estimator," IEEE Transactions on Acoustics, Speech and Signal Processing, vol. ASSP-32, No. 6, pp. 1109-1121, Dec. 1984.

Pierre Comon, "Independent component analysis, A new concept?," Signal Processing, vol. 36, No. 3, pp. 287-314, 1994.

Daniel D. Lee et al., "Learning the parts of objects by nonnegative matrix factorization," Nature 401 (6755), pp. 788-791, 1999.

International Search Report mailed by Japan Patent Office dated Apr. 8, 2014 in the corresponding PCT Application No. PCT/JP2013/084976—5 pages.

Written Opinion (Japanese language only) mailed by Japan Patent Office dated Apr. 8, 2014 in the corresponding PCT Application No. PCT/JP2013/084976—8 pages.

* cited by examiner

METHOD AND ELECTRONIC DEVICE

CROSS-REFERENCE TO RELATED APPLICATIONS

This application is a continuation of International Application No. PCT/JP2013/084976, filed on Dec. 26, 2013, the entire contents of which are incorporated herein by reference.

FIELD

Embodiments described herein relate generally to a method, and an electronic device.

BACKGROUND

There is a known technique for controlling the volume balance of an audio signal output from television devices, personal computers (PCs), or tablet terminals so as to enhance the voice components and background sound components of the audio signal.

Such a conventional technique may not be able to realize sufficient enhancements of the voice components and the background components by merely controlling the volume balance of the audio signal. Thus, there is a demand for enhancing the voice components and the background components effectively.

BRIEF DESCRIPTION OF THE DRAWINGS

A general architecture that implements the various features of the invention will now be described with reference to the drawings. The drawings and the associated descriptions are provided to illustrate embodiments of the invention and not to limit the scope of the invention.

DETAILED DESCRIPTION

In general, according to one embodiment, a method performed by an electronic device comprises: receiving an audio signal comprising voice and background sound via a microphone; receiving a user's operation to set a loudness of the voice or the background sound; setting a balance between a first gain of the voice and a second gain of the background sound according to the user's operation; separating the input audio signal into a first signal of the voice and a second signal of the background sound; amplifying the first signal according to the first gain; amplifying the second signal according to the second gain; and outputting the first signal and the second signal at least partially overlapping each other via a speaker.

The following embodiments will describe examples of a television device to which an electronic device is applied. However, the electronic device of any of the embodiments should not be limited to the television device, for example, applicable to an arbitrary device capable of outputting sound such as a personal computer (PC) and a tablet terminal.

First Embodiment

Figure 1:
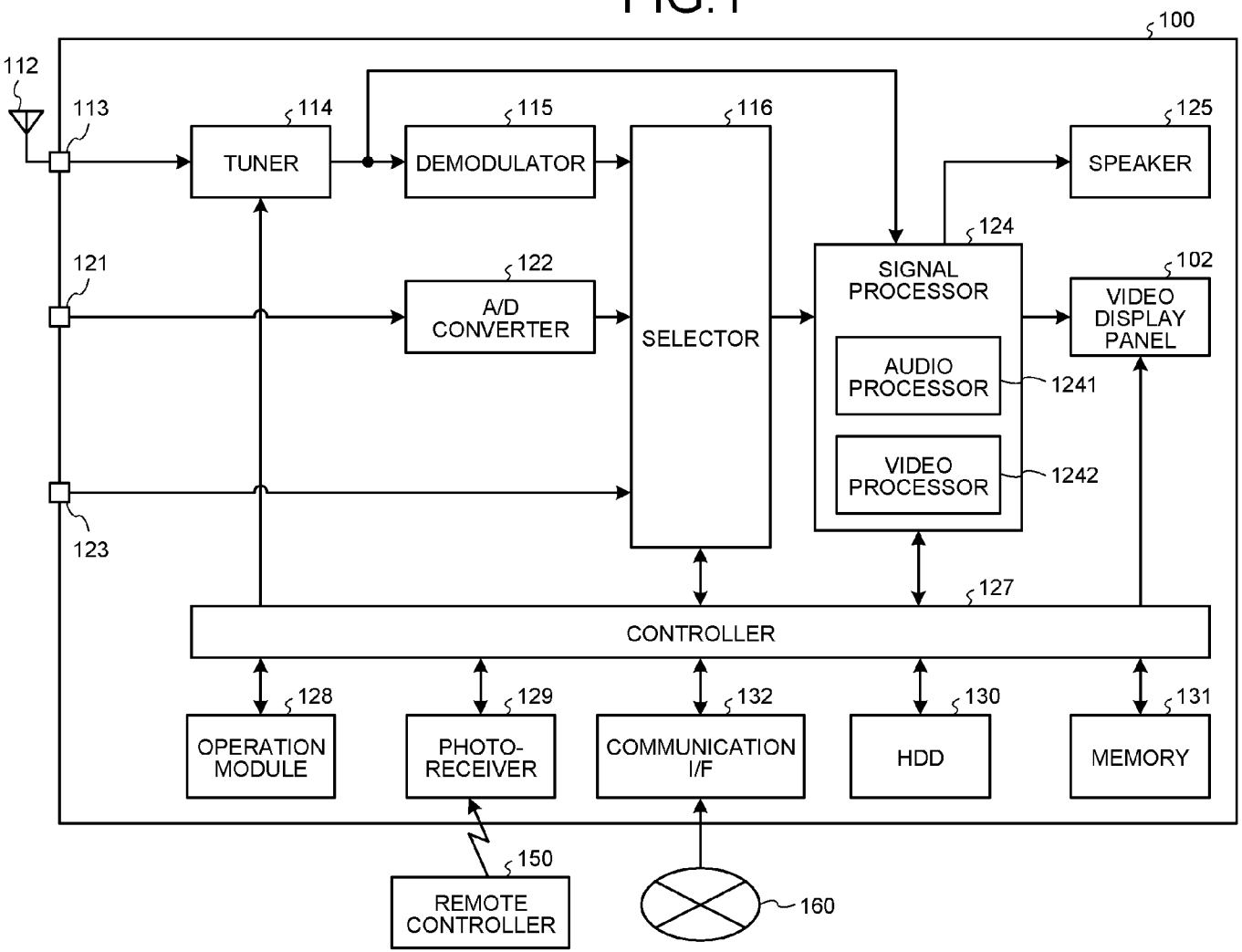
FIG. 1 is a configuration block diagram of a digital television according to a first embodiment.

As illustrated in FIG. 1, a television device 100 according to the present embodiment is a stationary video display device that receives broadcast waves of digital broadcasting and extracts video signals therefrom to display a video program. The television device 100 is also provided with recording and reproducing functions.

As illustrated in FIG. 1, the television device 100 includes an antenna 112, an input terminal 113, a tuner 114, and a demodulator 115. The antenna 112 receives broadcast waves of digital broadcasting and supplies the broadcast signals of the broadcast waves to the tuner 114 via the input terminal 113.

The tuner 114 selects a broadcast signal of a desired channel from the input broadcast signals of digital broadcasting, and supplies the broadcast signal to the demodulator 115. The demodulator 115 demodulates a digital video signal and an audio signal from the broadcast signal and supplies them to a selector 116, which will be described later.

The television device 100 also includes input terminals 121 and 123, an analog/digital (A/D) converter 122, a signal processor 124, a speaker 125, and a video display panel 102.

The input terminal 121 receives analog video and audio signals from outside, and the input terminal 123 receives digital video and audio signals from outside. The A/D converter 122 converts the analog video and audio signals supplied from the input terminal 121 to digital signals and supplies them to the selector 116.

The selector 116 selects one of the digital video signal and audio signal supplied from the demodulator 115, the A/D converter 122, and the input terminal 123 and supplies the selected signal to the signal processor 124.

The signal processor 124 includes an audio processor 1241 and a video processor 1242. The video processor 1242 performs a predetermined signal processing and scaling on the input video signal and supplies the processed video signal to the video display panel 102. The video processor 1242 also generates an on-screen display (OSD) signal to display video on the video display panel 102. The television device 100 includes at least a transport stream (TS) demultiplexer and a moving picture experts group (MPEG) decoder. A signal decoded by the MPEG decoder is input to the signal processor 124.

The audio processor 1241 performs a predetermined signal processing on a digital audio signal input from the selector 116, converts the digital audio signal to an analog audio signal, and outputs it to the speaker 125. The audio processor 1241 will be described in detail later. The speaker 125 receives the audio signal from the signal processor 124 and generates audio from the audio signal for output.

The video display panel 102 includes a flat panel display such as a liquid crystal display and a plasma display. The video display panel 102 receives the video signal from the signal processor 124 to display video.

The television device 100 further includes a controller 127, an operation module 128, a photoreceiver 129, a hard disk drive (HDD) 130, a memory 131, and a communication interface (I/F) 132.

The controller 127 integrally controls various operations of the television device 100. The controller 127 is a microprocessor incorporating a central processing unit (CPU). The controller 127 receives operation information from the operation module 128. The controller 127 also receives operation information from a remote controller 150 via the photoreceiver 129 and controls the modules on the basis of the operation information. The photoreceiver 129 of the present embodiment receives infrared rays from the remote controller 150.

The controller 127 uses the memory 131. The memory 131 includes a read only memory (ROM), a random access memory (RAM), and a non-volatile memory. The ROM stores therein control programs executed by the CPU incorporated in the controller 127. The RAM provides a work area for the CPU. The non-volatile memory stores therein various types of setting information and control information.

The HDD 130 functions as a storage that records the digital video and audio signals selected by the selector 116. The television device 100 can record the digital video and audio signals selected by the selector 116 on the HDD 130 as recording data. The television device 100 can also reproduce video and audio from the digital video and audio signals recorded on the HDD 130.

The communication I/F 132 is connected to various kinds of communication devices (such as a server) via a public network 160. The communication I/F 132 receives programs and services usable by the television device 100 and transmits various types of information.

Figure 2:
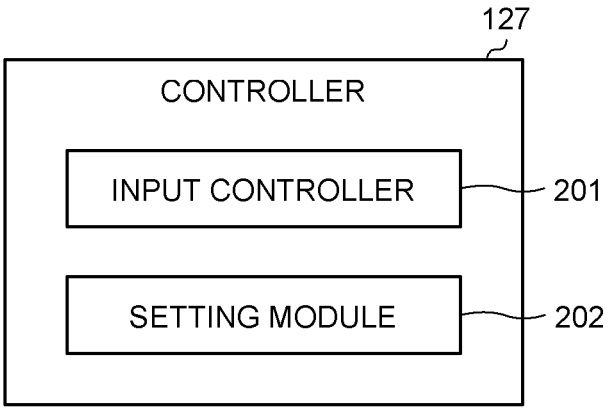
FIG. 2 is an exemplary block diagram of a functional configuration of a controller in the first embodiment.

Next, a functional configuration of the controller 127 will be described. As illustrated in FIG. 2, the controller 127 according to the present embodiment includes an input controller 201 and a setting module 202.

The input controller 201 receives a user's operation input to the remote controller 150 via the photoreceiver 129, and also receives a user's operation input to the operation module 128. In the present embodiment, the input controller 201 receives the volume (loudness) setting of a voice component signal between the voice component signal and the background component signal contained in the input audio signal.

Here, the audio signal includes a signal of a human voice component and a signal of a background sound component other than voice such as music. The voice component signal is an example of a first sound and the background sound component signal is an example of a second sound. Hereinafter, the voice component signal will be referred to as a voice signal and the background sound component signal will be referred to as a background sound signal. The voice signal is an example of a first signal and the background sound signal is an example of a second signal.

Figure 3:
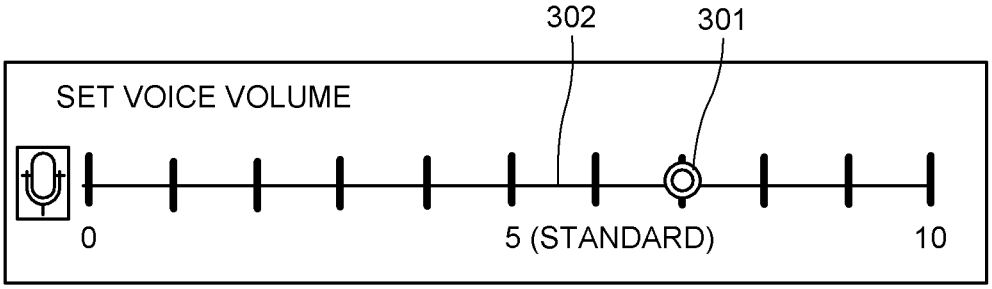
FIG. 3 is an exemplary diagram of a voice volume screen in the first embodiment.

In the present embodiment, the video processor 1242 of the signal processor 124 displays a voice volume screen on the video display panel 102 as an OSD. FIG. 3 is a diagram of a voice volume screen according to the first embodiment. In FIG. 3, it is possible to set the volume of voice in ten levels from 0 to 10 on the scale of a bar 302.

At voice volume of 0, almost no voice component is output and only the background sound component is output. In this case, the background sound volume is at 10. The voice volume of 5 is a standard value (reference value) when the voice component and the background sound component are output at equal strengths (volume), and the volume 5 is a default value. In this case, the background sound volume is also at 5. The voice volume of 10 is an output of only the voice component and almost no output of background sound component. In this case, the background sound volume is at 0.

A user moves a button 301 on the bar 302 on the voice volume screen to set a desired voice volume. The input controller 201 receives the setting of the voice volume designated on the voice volume screen. The voice volume screen and the volume levels should not be limited to those illustrated in FIG. 3 and may be arbitrarily set.

Returning to FIG. 2, the setting module 202 calculates the volume (loudness) of the background sound from the volume (loudness) of the voice received by the input controller 201. The setting module 202 calculates the background sound volume by subtracting the set voice volume from the maximum volume of 10. In other words, upon receiving a user's input for increasing the voice volume, the setting module 202 sets a reduction in the background sound volume. For example, when a user sets an increase in the voice volume to 7 from the voice volume of 5 and the background sound volume of 5, the setting module 202 reduces the value of the background sound volume from 5 to 3.

The setting module 202 then determines balance information that indicates the balance between the voice component and the background sound component, from the voice volume and the background sound volume. The balance information represents values from −1 to +1. The voice component is increased in the negative direction while the background sound component is increased in the positive direction.

In other words, when the balance information indicates −1, the voice component is most enhanced, the voice volume is set to 10 by the user, and the background sound volume is at 0. Also, when the balance information indicates +1, the background sound component is most enhanced, the voice volume is set to 0 by the user, and the background sound volume is at 10. When the balance information indicates 0, the voice component and the background sound component are equally enhanced and the voice volume and the background sound volume are both at "5". In the present embodiment, the balance information indicating 0, that is, both the voice volume and the background sound volume at 5 is defined to be a default value (reference value) by way of example. However, it should not be limited to such an example.

Figure 4:
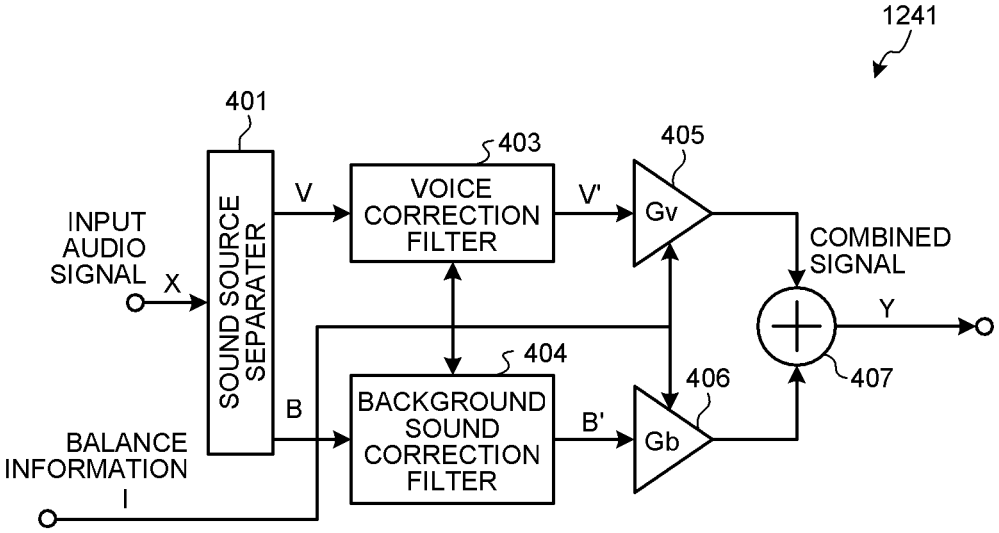
FIG. 4 is an exemplary configuration diagram of an audio processor in the first embodiment.

The audio processor 1241 of the signal processor 124 will now be described. As illustrated in FIG. 4, the audio processor 1241 of the present embodiment includes a sound source separator 401, a voice correction filter 403, a background sound correction filter 404, a gain Gv 405, a gain Gb 406, and an adder 407.

The sound source separator 401 separates an input audio signal into a voice component V (voice signal V) and a background sound component B (background sound signal B). The sound source separator 401 may use any separation method for the audio signal, for example, disclosed in Boll, S., "Suppression of acoustic noise in speech using spectral subtraction," IEEE ASSP Trans., 27, pp. 113-120, 1979 (Document 1); Ephraim, Y. and Malah, D., "Speech enhancement using a minimum-mean square error short-time spectral amplitude estimator," IEEE ASSP Trans., 32, pp. 1109-1121 (Document 2); Comon, P., "Independent component analysis, A new concept?," Signal Processing, Vol. 36, No. 3, pp. 287-314, 1944 (Document 3); and Daniel D. Lee and H. Sebastian Seung, "Learning the parts of objects by non-negative matrix factorization". Nature 401 (6755): pp. 788-791, 1999 (Document 4). In particular, the non-negative matrix factorization (NMF) disclosed in Document 4 has been actively studied as a technique to separate musical sound and audio.

The voice correction filter 403 corrects the characteristic of the voice signal V and outputs a corrected voice signal V'. The background sound correction filter 404 corrects the characteristic of the background sound signal B and outputs a corrected background sound signal B'.

As for the correction filters 403 and 404, various types are available such as the one that uses a fixed value (only gain control) and the one that uses the correlation between the channels such as surround. For example, with use of a filter, which is used for a hearing aid that enhances the frequency characteristic of voice, for the voice correction filter 403 of, the voice signal V, only the voice can be heard more clearly without affecting the background component. The background sound correction filter 404 may be a filter that enhances the frequency band excessively suppressed through the sound source separation, a filter that can add auditory effects in the similar manner to an equalizer attached to a music player, or a filter based on a pseudo-surround technique when the background sound signal is a stereo signal.

As for controlling the strength of the correction filter, for example, the corrected voice signal V' is represented by the following formula (1):

$$V'=|Hv(f)|\cdot V \tag{1}$$

where |Hv(f)| is a decibel (dB) value of the amplitude characteristic of the voice correction filter 403 and f is a frequency index.

Here, |Hv(f)| is represented by the following formula (2):

$$|Hv(f)|=Jv(I)\cdot|Fv(f) \tag{2}$$

where |Fv(f)| is the dB value of the filter that enhances the frequency characteristic of the voice signal.

By multiplying Fv(f) by the strength Jv, the filter characteristic is smoothened with the decrease in Jv. When Jv=0, |Hv(f)|=0 dB. This is equivalent to no filter processing.

Similarly, the corrected background sound signal B' is represented by the following formula (3):

$$B'=|Hb(f)|\cdot B \tag{3}$$

where |Hb(f)| is the dB value of the amplitude characteristic of the background sound correction filter 404.

Here, |Hb(f)| is represented by the following formula (4):

$$|Hb(f)|=Jb(I)\cdot|Fb(f)| \tag{4}$$

where |Fb(f)| is the dB value of the filter that enhances the frequency characteristic of the background sound signal.

Figure 6:
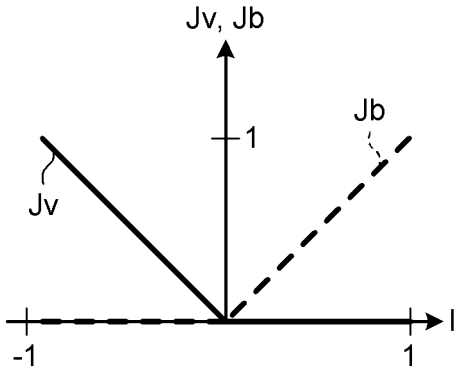
FIG. 6 is an exemplary diagram showing a relation between balance information and the strength of a voice correction filter, and the strength of a background sound correction filter in the first embodiment.

The strength Jv is an example of a first parameter and the strength Jb is an example of a second parameter. Jv(I) represents the strength Jv of the voice correction filter 403 when the balance information is I. Jb(I) represents the strength Jb of the background sound correction filter 404 when the balance information is I. An example of Jv(I) and Jb(I) is shown in FIG. 6.

The voice signal V' corrected by the voice correction filter 403 is multiplied by the gain Gv 405, and the background sound signal B' corrected by the background sound correction filter 404 is multiplied by the gain Gb 406.

Here, the audio processor 1241 according to the present embodiment receives balance information I from the setting module 202 of the controller 127, and changes the strengths of the correction of the voice correction filter 403 and the background sound correction filter 404 according to the value of the balance information I. The audio processor 1241 also changes the gains Gv 405 and Gb 406 according to the value of the balance information I.

Figure 5:
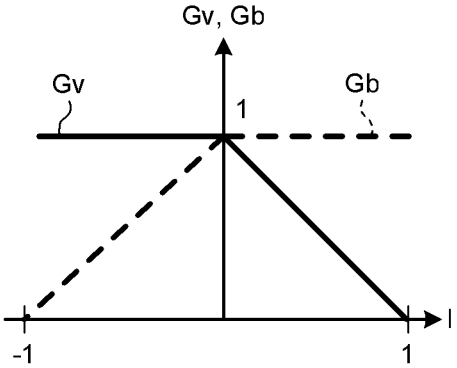
FIG. 5 is an exemplary diagram showing a relation between balance information and gains Gv and Gb in the first embodiment.

FIG. 5 is a diagram showing a relation between the balance information I and the gain Gv 405 and the gain Gb 406 according to the first embodiment. In FIG. 5, the horizontal axis represents the balance information I while the vertical axis represents the gain Gv 405 and the gain Gb 406. As illustrated in FIG. 5, at the balance information I of −1, that is, the maximum voice volume set by a user, the gain Gb is at 0 and only voice can be heard (voice enhancement mode).

Along with an increase in the balance information I from −1 to 0, the gain Gb increases gradually from 0 although the gain Gv maintains a constant value. At the balance information I of 0, that is, the standard value of the voice volume set by the user, both the gains Gv and Gb are at 1. Thus, the voice and the background sound are equally output with no change in the balance between the voice and the background sound.

As the balance information I increases from 0 to +1, the gain Gv decreases gradually from 1 although the gain Gb maintains the constant value. At the balance information I of 1, that is, the minimum voice volume set by the user, the gain Gv is at 0 and only the background sound can be heard (background enhancement mode).

FIG. 6 is a diagram showing a relation between the balance information I and the strength Jv of the voice correction filter 403 and the strength Jb of the background sound correction filter 404 according to the first embodiment. In FIG. 6, the horizontal axis represents the balance information I while the vertical axis represents the strengths Jv and Jb. As illustrated in FIG. 6, at the balance information I of −1, that is, the maximum voice volume set by the user, the strength Jv of the voice correction filter 403 becomes maximal and the strength Jb of the background sound correction filter 404 is at 0.

As the balance information I increases from −1 to 0, the strength Jv of the voice correction filter 403 decreases gradually and the strength Jb of the background sound correction filter 404 maintains 0. At the balance information I of 0, that is, the standard voice volume set by the user, both the strengths Jv and Jb are at 0, and both the voice and the background sound will not be corrected.

As the balance information I increases from 0 to +1, the strength Jb increases gradually from 0 and the strength Jv maintains 0. At the balance information I of 1, that is, the minimum voice volume set by the user, the strength Jb of the background sound correction filter 404 becomes maximal.

Figure 7:
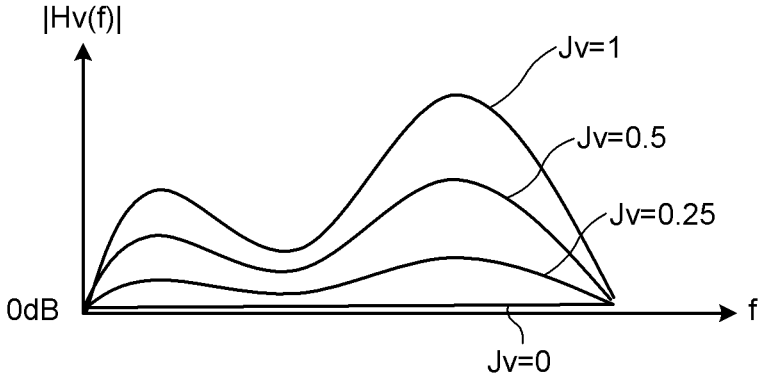
FIG. 7 is an exemplary diagram showing a relation between the frequency index of a voice signal and a dB value $|Hv(f)|$ of the amplitude characteristic of the voice correction filter.

As illustrated in FIGS. 5 and 6, when the balance information I is 0, Gv=Gb=1 and Jv=Jb=0. This signifies no filtering (correction) by the voice correction filter 403 and the background sound correction filter 404 and the voice and the background sound mixed with unchanged balance. Thus, a combined signal Y matches an input audio signal X. FIG. 7 is a diagram showing a relation between the frequency index f of a voice signal and the dB value |Hv(f)| of the amplitude characteristic of the voice correction filter 403 by way of example. The horizontal axis represents the frequency index f of the voice signal while the vertical axis represents the dB value |Hv(f)| of the amplitude characteristic of the voice correction filter 403. In FIG. 7, the respective values of the strength Jv of the voice correction filter 403 draw curves indicating the relation between the frequency index f of the voice signal and the dB value |Hv(f)| of the amplitude characteristic of the voice correction filter 403.

Along with a decrease in the balance information I to −1, the gain Gb of the background sound decreases and the strength Jv of the voice increases to the contrary. Thus, as the background sound decreases, the strength Jv of the voice increases. A decreased overall volume by a decrease in the background sound may be confused with a decrease in the voice volume. However, in the present embodiment, the television device 100 can improve the auditory quality by increasing the voice volume with the voice correction filter 403 or enhancing the frequency characteristic.

The same effects are attained in a case where the balance information I increases from 0 toward +1. As the gain Gv of the voice signal decreases, the strength Jb of the background sound correction filter 404 increases. Thereby, the television device 100 can enhance the background sound effectively.

Returning to FIG. 4, the adder 407 adds the voice signal multiplied by the gain Gv 405 to the background sound signal multiplied by the gain Gb 406, so that they partially overlap each other. The adder 407 then outputs the combined signal Y of both of the signals. The adder 407 is an example of an output module.

A notation of signals will now be described. In case of discrete-time signals, the audio signal X to be input is denoted by X=x(n) where n is an integer. The audio signal X when divided on a frame basis by the audio processor 1241 is denoted by X=x(m,n) where m is a frame number and n is a sample number.

The audio processor 1241 can also convert the audio signal x(m,n) to a frequency domain X(m,f) by a Fourier transform where m may be a frame number and f may be a frequency index. With use of a continuous time signal, the audio signal X is denoted by X=x(t) and can be converted to a frequency domain in the same manner.

The signals other than the audio signal X are denoted in the same manner. In case of multichannel, the audio signal X is represented in vector form. For example, when the audio signal is a stereo signal, it is represented by X=(xl(n), xr(n)), an N channel is represented by X=(x1(n), x2(n), . . . , xN(n)). When the audio signal is a stereo signal, a left right (LR) signal may be represented by a mid-side (MS) signal. An M signal and an S signal are represented by the following formulae (5) and (6), respectively.

$$xm(n)=(x1(n)+xr(n))/2 \tag{5}$$

$$xs(n)=(x1(n)-xr(n))/2 \tag{6}$$

Thus, X=(xm(n), xs(n)) holds true. The MS signal can be also converted by a Fourier transform. According to the present embodiment, the combined signal Y can be also obtained with use of the MS signal. By inversely converting the MS signal by the following formulae (7), (8), and (9), the LS signal can be generated from the obtained combined signal Y.

$$Y=(ym(n),ys(n)) \tag{7}$$

$$yl(n)=ym(n)+ys(n) \tag{8}$$

$$yr(n)=ym(n)-ys(n) \tag{9}$$

The MS signal from the may be inversely converted in the middle of the process by the audio processor 1241 to process the LR signal thereafter. Unless otherwise specifically mentioned, these signals are collectively denoted as X hereinafter.

Figure 8:
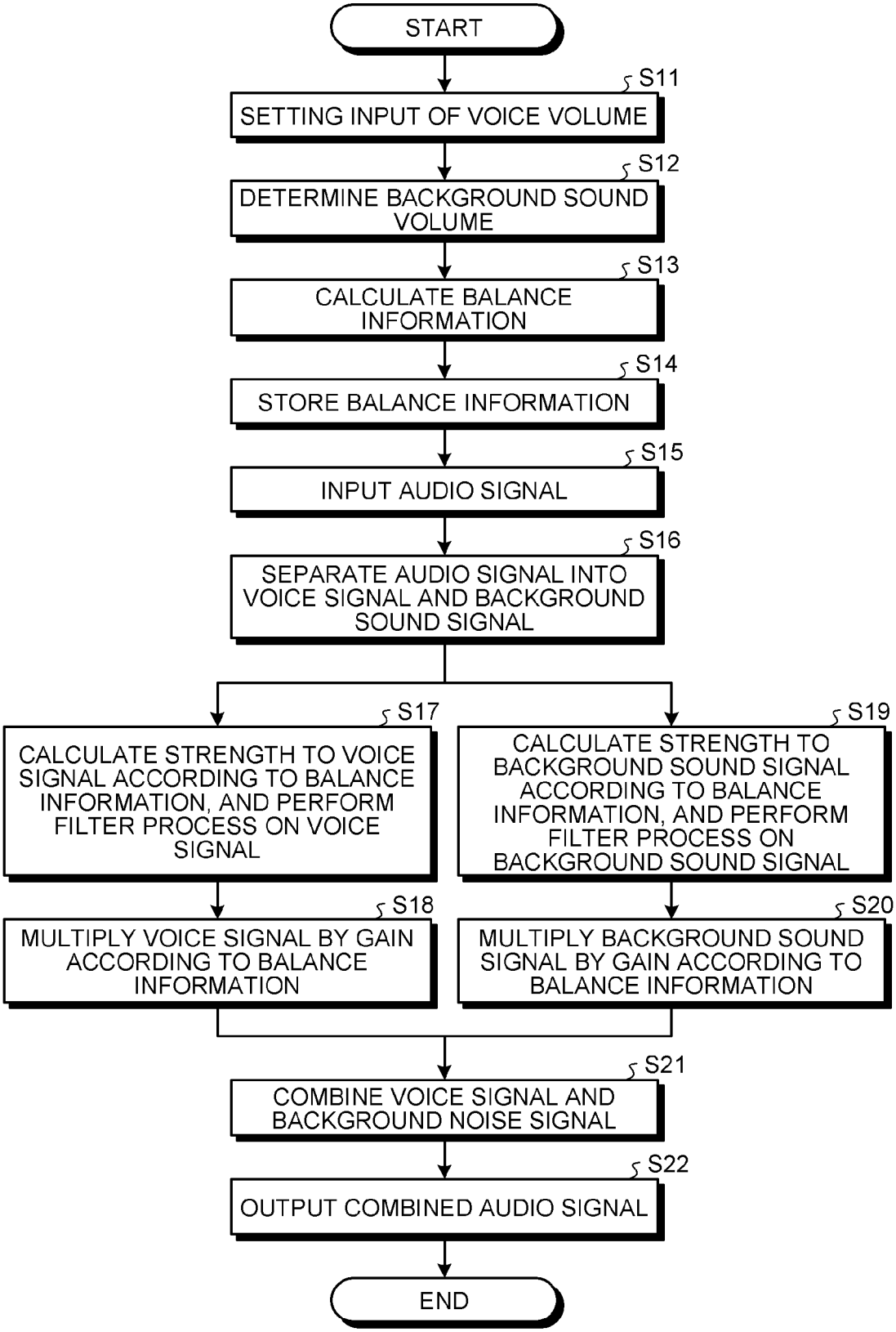
FIG. 8 is an exemplary flowchart of an audio output process in the first embodiment.

The audio output process of the television device 100 according to the present embodiment configured as above will now be described with reference to FIG. 8.

When a user inputs a desired voice volume onto the voice volume screen illustrated in FIG. 3, the input controller 201 of the controller 127 receives the input voice volume (S11). Next, the setting module 202 of the controller 127 determines a background sound volume from the voice volume (S12). The setting module 202 then calculates the balance information from the voice volume and the background sound volume (S13). The setting module 202 also stores the calculated balance information in the memory 131 (S14).

The audio processor 1241 receives the audio signal from the selector 116 (S15). The sound source separator 401 of the audio processor 1241 separates the audio signal into the voice signal V and the background sound signal B (S16).

The voice correction filter 403 calculates the strength Jv according to the balance information as described above and performs filtering on the voice signal V with the strength Jv (S17). The audio processor 1241 then multiplies the filtered voice signal V' by the gain Gv set according to the balance information (S18).

The background sound correction filter 404 calculates the strength Jb according to the balance information as described above and performs filtering on the background sound signal B with the strength Jb (S19). The audio processor 1241 then multiplies the filtered background sound signal B' by the gain Gb set according to the balance information (S20).

The adder 407 combines the voice signal V' multiplied by the gain Gv and the background sound signal B' multiplied by the gain Gb (S21). The audio processor 1241 then outputs the combined audio signal Y to the speaker 125 (S22).

Thus, in the present embodiment, a user only needs to set the volume of the voice component of the audio signal. The background sound volume is then determined, and the audio signal in the volume corresponding to the gain which is set according to the balance information calculated based on the user's desired volume. Thus, the television device 100 according to the present embodiment can enhance voice and background sound effectively.

Meanwhile, for increasing or enhancing the volume of voice or background sound with the sound source separation, merely controlling the volume balance may not be able to realize sufficient effects. For example, to enhance voice, suppression of the background sound results in lowering the overall volume, which may give an impression that the voice also becomes weakened. Also, in enhancing background sound, insufficient separation performance may suppress a part of the background sound together with voice, altering audio quality. In view of this, in the present embodiment, the television device 100 applies the correction filter, the gain Gv, and the gain Gb on the voice signal and the background sound signal after the separation of the sound source of the audio signal and controls the strengths of the correction filters 403 and 404 and the gain Gv and the gain Gv on the basis of the balance information for controlling the volume balance between the voice signal and the background sound signal. Hence, according to the present embodiment, the television device 100 can enhance the voice and the background sound effectively according to the balance between the voice and the background sound.

In the present embodiment, the television device 100 filters the voice signal and the background sound signal with the correction filter according to the balance information after the sound source separation, and multiplies the signals by the gain according to the balance information. However, the voice signal and the background sound signal can be multiplied by the gain according to the balance information without the filtering after the sound source separation.

The present embodiment has described the example where the input controller 201 receives the voice volume set by the user and the setting module 202 determines the background sound volume from the set voice volume to calculate the balance information. However, the present embodiment should not be limited to such an example. The volume of at least one of the voice and the background sound may be specified. For example, the input controller 201 and the setting module 202 may be configured to determine the voice volume from the background sound volume set by the user and calculate the balance information. In this case, the setting module 202 may be configured to reduce the voice volume, upon receiving a user's setting to increase the background sound volume.

In the present embodiment, in response to a user's setting to increase the voice volume, the setting module 202 increases the voice volume by reducing the background sound volume. However, the setting module 202 may be configured to increase the background sound volume to the standard value, responding to a user's setting to increase the voice volume from the standard value.

The input controller 201 may be configured so as to receive user's settings for both of the voice volume and the background sound volume. In this case, the setting module 202 can determine the balance information from the received voice volume and background sound volume.

Second Embodiment

In the first embodiment, the voice signal and the background sound signal are filtered with the correction filter according to the balance information and multiplied by the gain according to the balance information after the sound source is separated. In the electronic devices such as the television device 100, the audio signal can be subjected to post-processing for sound effects such as surround. However, the post-processing may result in adding unsuitable or excessive effects on the audio signal and degrading the quality of the audio signal. To prevent this from occurring, the second embodiment is configured that the combined audio signal is additionally subjected to post-processing according to the balance information.

The configuration of the television device 100 according to the present embodiment is the same as that in the first embodiment. The present embodiment is different from the first embodiment in the configuration of the audio processor 1241.

Figure 9:
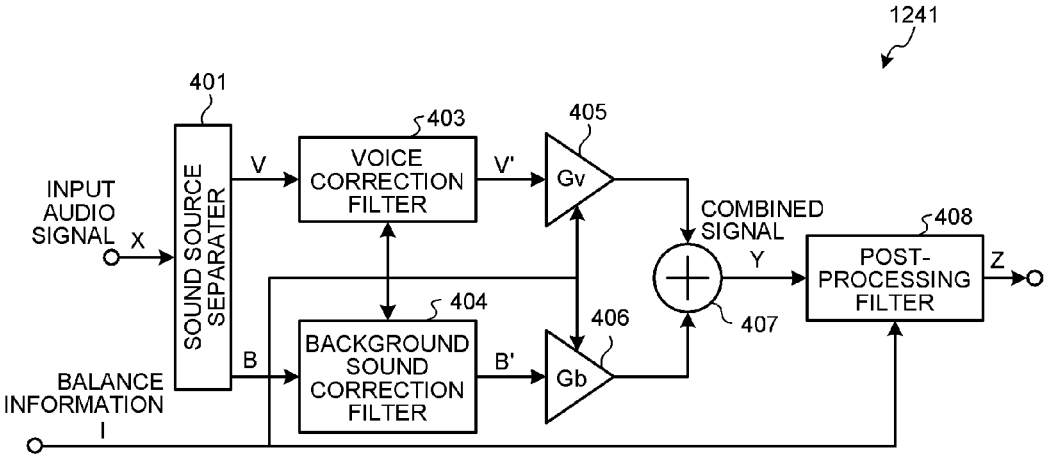
FIG. 9 is an exemplary configuration diagram of the audio processor according to a second embodiment.

As illustrated in FIG. 9, the audio processor 1241 according to the present embodiment includes the sound source separator 401, the voice correction filter 403, the background sound correction filter 404, the gain Gv 405, the gain Gb 406, the adder 407, and a post-processing filter 408. Here, the functions and configurations of the sound source separator 401, the voice correction filter 403, the background sound correction filter 404, the gain Gv 405, the gain Gb 406, and the adder 407 are the same as those in the first embodiment.

Figure 10:
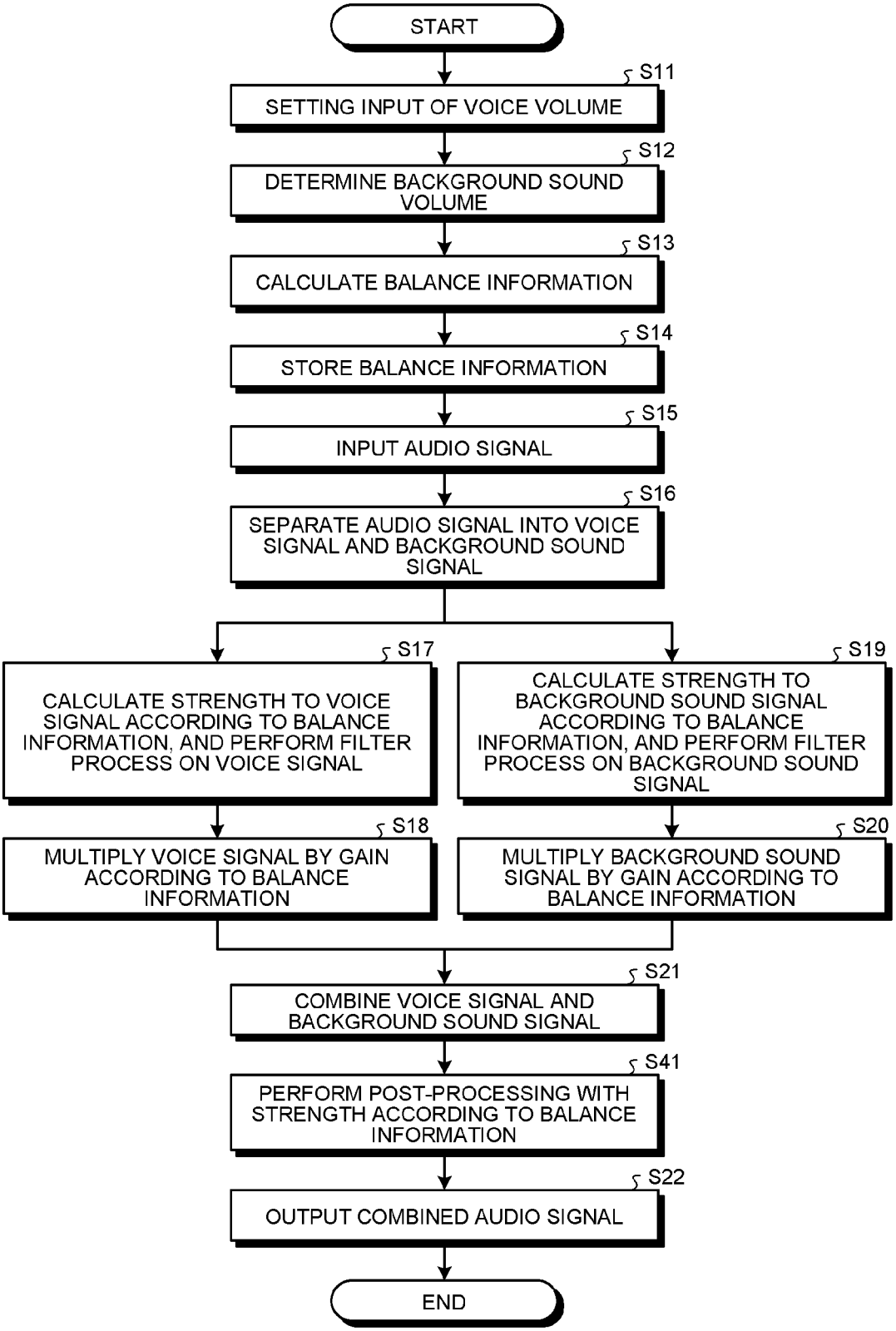
FIG. 10 is an exemplary flowchart of the audio output process in the second embodiment.

FIG. 10 is a flowchart of the audio output process according to the second embodiment by way of example. The process from the reception of the set voice volume to the combining of the voice signal and the background sound signal (S11 to S21) is performed in the same manner as in the first embodiment.

After the voice signal and the background sound signal are combined (S21), the post-processing filter 408 performs post-processing on the combined audio signal with the strength set according to the balance information (S41). The audio processor 1241 then outputs the processed audio signal to the speaker 125 (S22).

The post-processing filter 408 performs post-processing such as surround and bass boost (bass enhancement). However, the post-processing may degrade the quality of the combined audio signal Y. In general, since the post-processing is designed for the audio signal X to be input, it may not generate sufficient effects on the combined audio signal Y with a changed balance of the voice and background sound.

Further, the similar post-processing by the correction filters 403 and 404 and the post-processing filter 408 may produce excessive sound effects and degrade the audio quality. For example, By enhancement of soundscape (surround process) with both of the background sound correction filter 404 and the post-processing filter 408, the background sound signal is subjected to the surround process twice with both of the filters. This may cause a user to feel unfamiliarity to the sound quality.

In view of the above, in the present embodiment, the post-processing filter 408 is configured to perform post-processing on the combined audio signal with the strength Jp based on the balance information I.

Figure 11:
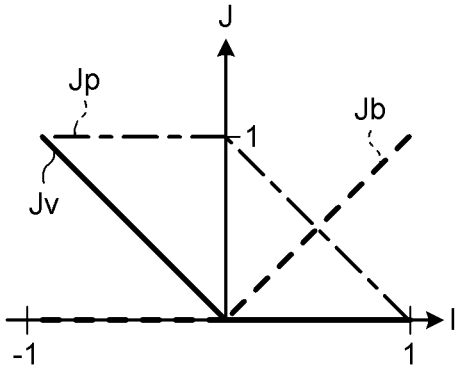
FIG. 11 is an exemplary diagram showing a relation between the strength Jp of a post-processing filter, the strength Jv of a voice correction filter, and the strength Jb of a background sound correction filter, and the balance information I in the second embodiment.

FIG. 11 is a diagram showing a relation between the strength Jp of the post-processing filter, the strength Jv of the voice correction filter, and the strength Jb of the background sound correction filter, and the balance information I according to the second embodiment by way of example.

As illustrated in FIG. 11, along with an increase in the balance information I from 0 in the positive direction to enhance the background sound, the strength Jb of the background sound correction filter 404 increases while the strength Jp of the post-processing filter lowers. At the balance information I of 1, the strength Jp is at 0. Thus, only the background sound correction filter 404 generates effects and the post-processing filter 408 virtually produces no effects.

As described above, by changing the strength Jp according to the balance information I, it is possible to maintain the surround effects constantly regardless of the value of the balance information on the voice and background sound.

For the purpose of maintaining the surround effect alone, the surround effects of the post-processing filter 408 can be always set to the strength Jp of 1 with no use of the background sound correction filter 404. However, the post-processing filter 408 is designed for the input audio signal, so that it may not produce appropriate effects on the audio signal, the background sound of which is enhanced by the balance adjustment. Moreover, the voice component of the signal is also subjected to the post-processing to enhance the surround effects at the strength of Jp=1.

Meanwhile, the present embodiment is configured that the strength Jp is lowered as the value of the balance information is increased, thereby reducing the surround effects of the post-processing filter 408. That is, the strength of the post-processing filter 408, which is too strong to be consistent with the volume of the background sound component, is attenuated. Also, not only the volume but also the surround effect of the voice component can be reduced.

Figure 12:
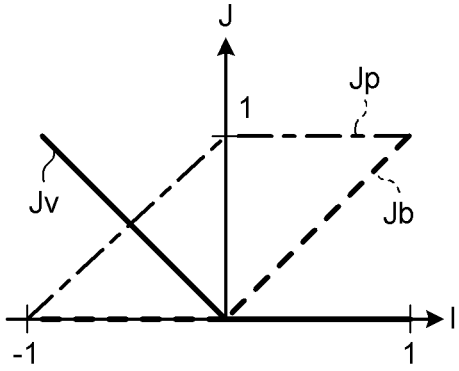
FIG. 12 is an exemplary diagram showing a relation among another strength Jp of the post-processing filter, the strength Jv of the voice correction filter, and the strength Jb of the background sound correction filter, and the balance information I in the second embodiment.

FIG. 12 is a diagram showing a relation between another strength Jp of the post-processing filter 408, the strength Jv of the voice correction filter, and the strength Jb of the background sound correction filter, and the balance information I according to the second embodiment by way of example. FIG. 12 shows the values obtained when the background sound correction filter 404 performs surround processing and the post-processing filter 408 performs post-processing for bass enhancement.

In FIG. 12, as the balance information I increases from 0 in the positive direction to enhance the background sound, the strength Jp for bass enhancement does not need to be lowered. On the other hand, for enhancing the voice component by decreasing the balance information I, considering the fact that too low bass is likely difficult to hear, the strength Jp is decreased as the balance information I is decreased. When the balance information I decreases to −1, the strength Jp is set to 0, whereby the bass enhancing effects are eliminated. Thus, the television device 100 is able to output audio to be easily heard.

If the enhanced bass sounds unnatural with an increase in the balance information I, t the strength Jp can be reduced along with the increase in the balance information I, as in the surround process. In this manner, the television device 100 can improve the overall sound effects by controlling the correction filters 403 and 404 and the post-processing filter 408 to change the respective strengths Jv, Jb and Jp according to the balance information I.

In the present embodiment, the correction filter performs the filtering on the audio signal according to the balance information, and the audio signal is multiplied by the gain according to the balance information. Furthermore, in the second embodiment, the combined audio signal is subjected to the post-processing according to the balance information. Thus, the television device 100 can improve the overall sound effects while suppressing unsuitable or excessive effects of the post-processing filter 408.

Further, the calculations by the voice correction filter 403, the background sound correction filter 404, and the post-processing filter 408 can be collectively made. That is, as in formula (10) below, a combined filter can be designed to perform the calculations for both the post-processing filter and the correction filters. This makes it possible for the audio processor 1241 to reduce the load of the calculation.

$$Z = Jp \cdot Hp \cdot Y = Jp \cdot Hp(Gv \cdot Jv \cdot Hv \cdot V + Gb \cdot Jb \cdot Hb \cdot B) = Gv \cdot Jp \cdot Hp \cdot Jv \cdot Hv \cdot V + Gb \cdot Jp \cdot Hp \cdot Jb \cdot Hb \cdot B \quad (10)$$

Third Embodiment

In the present embodiment, when the television device 100 is powered off after the balance information is set for audio output, and at power-on again, the balance information is found to indicate a different value from that of a normal viewing mode, the value of the balance information is returned to the default value.

The configuration of the television device 100 according to the third embodiment is the same as that in the first embodiment. The configuration of the audio processor 1241 of the third embodiment is also the same as that in the first embodiment.

Concerning the balance information indicating an increase in the voice volume to higher than the background sound volume, for example, when the voice volume is higher than the standard value and the background sound volume is lower than the standard value, when the television device 100 is powered off after the balance information is set, the setting module 202 according to the present embodiment maintains the validity of the volume setting corresponding to the balance information even after the power-on again.

On the other hand, concerning the balance information indicating an increase in the background sound volume to higher than the voice volume, for example, when the background sound volume is higher than the standard value and the voice volume is lower than the standard value, when the television device 100 is powered off after the balance information is set, upon the power-on again the setting module 202 invalidates the volume setting corresponding to the balance information.

Figure 13:
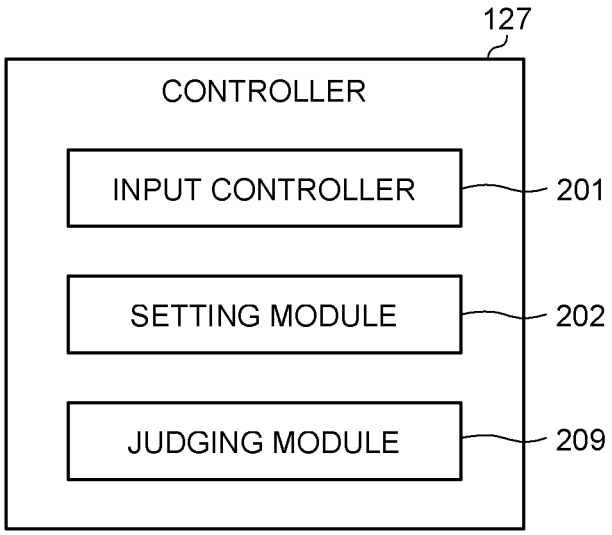
FIG. 13 is a block diagram illustrating a functional configuration of the controller according to a third embodiment.

FIG. 13 is a block diagram illustrating a functional configuration of the controller 127 according to the third embodiment. The controller 127 according to the present embodiment, as illustrated in FIG. 13, includes the input controller 201, the setting module 202, and a determiner 209. The function of the input controller 201 is the same as that in the first embodiment.

Figure 14:
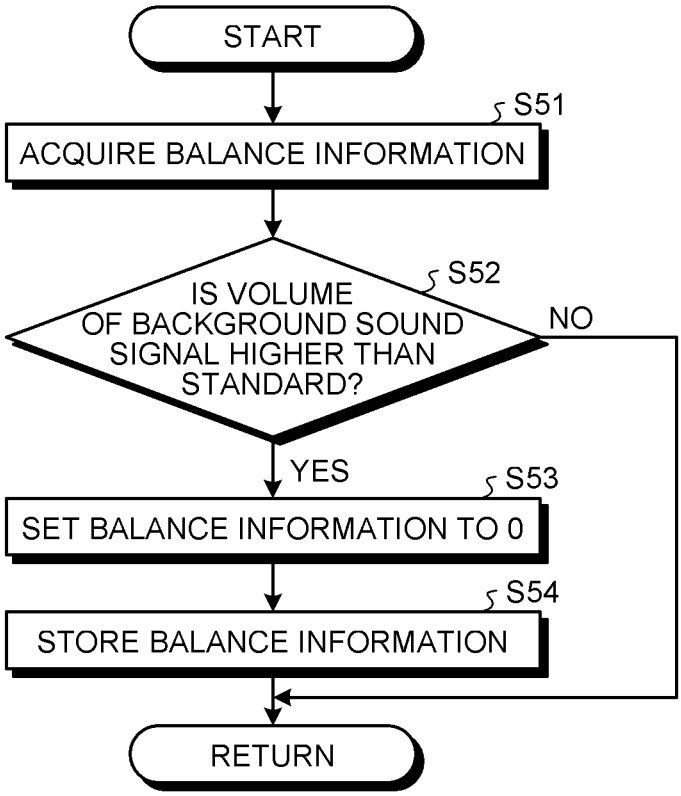
FIG. 14 is an exemplary flowchart of a control process in the third embodiment.

FIG. 14 is a flowchart a control process according to the third embodiment by way of example. The process illustrated in FIG. 14 is executed when the television device 100 is powered off once and then powered on again. Here, previously determined balance information is stored in the memory 131 at S14 in the first embodiment.

The determiner 209 reads out previous balance information stored before the power-off from the memory 131 (S51). The determiner 209 then determines whether the volume of the background sound signal is higher than the standard value (volume 5) as a reference value by determining whether the balance information is higher than 0 (S52).

When the volume of the background sound signal is higher than the standard value (Yes at S52), the determiner 209 determines that the voice volume is lower than the standard value and the television device 100 is placed in a different viewing mode from the normal viewing mode. In other words, the television device 100 is assumed to be in a special viewing mode in which a user is playing karaoke on a program with a lowered voice volume, for example.

Thus, the setting module 202 invalidates the balance information indicating the volume different from that of the normal viewing mode, and instead sets the balance information to the default value of 0 (S53). The setting module 202 then stores the balance information in the memory 131 (S54). Thereby, the voice and the background sound are equally output in volume.

Meanwhile, when the volume of the background sound signal is lower than the standard value (No at S52), the determiner 209 determines that a previous viewing mode is the normal viewing mode, and omits the process at S53 and S54. In other words, the setting module 202 maintains validity of the set balance information.

Thus, when the television device 100 is powered off after the balance information is set for the audio output and at the power-on again the value of the balance information is found to be different from that of the normal viewing mode, the balance information value is returned to the default value. Because of this, even if a user views a program temporarily in a special viewing mode and turns off the television device 100, the user is able to effectively view a new program in the normal viewing mode after the power-on again.

In the present embodiment, the process in FIG. 14 is executed after the power-on. However, it should not be limited thereto. For example, the determiner 209 and the setting module 202 can be configured so as to execute the process in FIG. 14 upon start of every program, to determine whether the value of the balance information is different from that of the normal viewing mode and return the value to the default value.

That is, when the balance information indicates an increase in the voice volume to higher than the background sound volume and the balance information is set while a user is viewing a first program, the setting module 202 maintains validity of the volume setting corresponding to the balance information even if a second program has started after completion of the first program.

On the other hand, when the balance information indicates an increase in the background sound volume to higher than the voice volume and the balance information is set while a user is viewing the first program, the setting module 202 invalidates the volume setting corresponding to the balance information when the second program has started after completion of the first program. Here, the setting module 202 can determine the end and start of a program, referring to an electronic program guide (EPG) received from an external server, for example. However, it should not be limited thereto.

Moreover, the determiner 209 and the setting module 202 can be configured so as to execute the process in FIG. 14 every time a user changes the channel, to determine whether the value of the balance information is different from that of the normal viewing mode and return the value to the default value.

In other words, when the balance information indicates an increase in the voice volume to higher than the background sound volume the balance information is set while a user is viewing broadcast on a first channel, and the user changes the first channel to a second channel, the setting module 202 detects a channel change and maintains validity of the volume setting corresponding to the balance information.

Meanwhile, when the balance information indicates an increase in the background sound volume to higher than the voice volume, the balance information is set while a user is viewing broadcast on the first channel, and the user changes the first channel to the second channel, the setting module 202 detects a channel change and invalidates the volume setting corresponding to the balance information.

Further, the setting module 202 and the determiner 209 can be configured to set the balance information to the default value (standard) of 0 when a previous mode is a special viewing mode in which the balance information is set to the maximum value of +1 and the voice signal volume is set to a first threshold value of 0, and a user increases the volume setting with the operation module or the remote controller.

Figure 15:
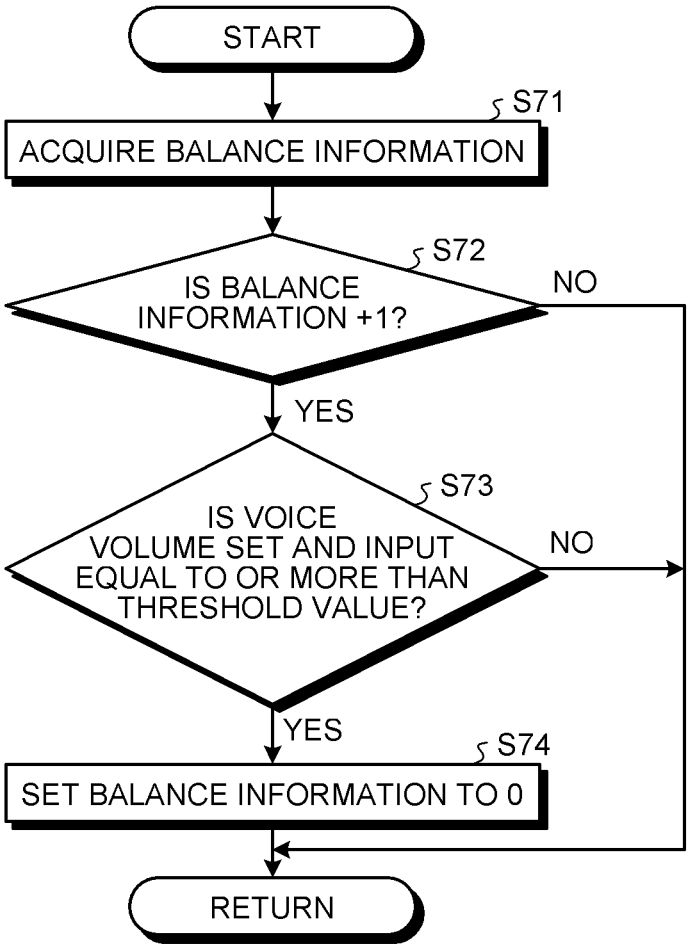
FIG. 15 is an exemplary flowchart of a control process in a modification of the third embodiment.

FIG. 15 is a flowchart of a control process according to a modification of the third embodiment by way of example. First, the determiner 209 reads out the balance information previously stored before the power-off from the memory 131 (S71). The determiner 209 then determines whether the previously set balance information is +1 (S72).

When determining that the previously set balance information indicates +1 (Yes at S72), the determiner 209 determines whether a user has operated the operation module to increase the voice volume to equal to or more than a predetermined second threshold value (S73). When determining that the user has operated to increase the voice volume to equal to or more than the predetermined second threshold value (Yes at S73), the determiner 209 determines that the previous volume setting is different from that of the normal viewing mode and the user wishes to view in the normal viewing mode. The setting module 202 then sets the balance information to the default value of 0 (S74).

When the user has not operated to increase the voice volume to the predetermined second threshold value (No at S73), the determiner 209 determines that the user wishes to view with the previous volume setting and omits the process at S74.

If the previously set balance information does not indicate +1 (No at S72), the determiner 209 determines that the previous viewing mode is the normal viewing mode and omits the process at S73 and S74.

According to the present modification, even if a user temporarily views a program in a special viewing mode and turns off the television device 100, the user can effectively view a new program in the normal viewing mode after the power-on again.

In the modification, the determiner 209 determines whether the balance information indicates the maximum value of +1 and the voice signal volume is set to the first threshold value of 0. Alternatively, the first threshold value of the voice signal volume can be set to other than 0.

The above embodiments have described the example where the user sets the voice volume on the voice volume screen illustrated in FIG. 3. However, it should not be limited to such an example. For example, a plurality of preset menus containing defined voice volumes can be prepared to allow a user to select a desired preset menu. Such a preset menu, for example, can be a setting button of a karaoke machine, in which the voice volume is set to 0.

The audio output processing program executed by the television device 100 according to any of the above embodiments is provided as a computer program product pre-stored on an ROM such as the memory 131, for example.

The audio output processing program executed by the television device 100 according to any of the above embodiments can be provided as a computer program product in an installable or executable file format recorded on a computer-readable recording medium such as a compact disc-read only memory (CD-ROM), a flexible disk (FD), a compact disc-recordable (CD-R), and a digital versatile disc (DVD), for instance.

Furthermore, the audio output processing program executed by the television device 100 according to any of the above embodiments described can be provided as a computer program product stored on a computer connected to a network such as the Internet and downloaded via the network. The audio output processing program executed by the television device 100 according to any of the above embodiments can also be provided or distributed as a computer program product via a network such as the Internet.

The audio output processing program executed by the television device 100 according to any of the above embodiments has a module configuration including the modules (input controller 201, setting module 202, determiner 209, sound source separator 401, voice correction filter 403, background sound correction filter 404, adder 407, and post-processing filter 408) described above. As actual hardware, the CPU reads and executes the audio output processing program from the ROM, thereby loading each of the modules on the RAM such as the memory 131 and implementing the input controller 201, the setting module 202, the determiner 209, the sound source separator 401, the voice correction filter 403, the background sound correction filter 404, the adder 407, and the post-processing filter 408 on the RAM.

Moreover, the various modules of the systems described herein can be implemented as software applications, hardware and/or software modules, or components on one or more computers, such as servers. While the various modules are illustrated separately, they may share some or all of the same underlying logic or code.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A method performed by an electronic device, comprising:

receiving an audio signal comprising voice and background sound other than voice via a microphone;

receiving a user's operation to set a loudness of the voice or the background sound;

setting a balance between a first gain of the voice and a second gain of the background sound according to the user's operation;

separating the input audio signal into a first signal of the voice and a second signal of the background sound;

correcting, by a first filter, a characteristic of the first signal with a first parameter and outputting a corrected first signal, the first parameter determined based on the balance;

correcting, by a second filter, a characteristic of the second signal with a second parameter and outputting a corrected second signal, the second parameter determined based on the balance;

amplifying the corrected first signal according to the first gain;

amplifying the corrected second signal according to the second gain; and outputting the corrected first signal multiplied by the first gain and the corrected second signal multiplied by the second gain at least partially overlapping each other via a speaker.

2. The method of claim 1, further comprising, in response to a user's operation to increase the loudness of one of the first signal and the second signal, automatically setting the balance to reduce loudness of the other one of the first signal and the second signal.

3. The method of claim 1, further comprising:

when the balance causes the loudness of the first signal to be larger than the loudness of the second signal, maintaining validity of the setting of the balance even if an electronic device for which the balance has been set is powered off and then powered on again; and when the balance causes the loudness of the second signal to be larger than the loudness of the first signal and the electronic device for which the balance has been set is powered off, invalidating the setting of the balance when the electronic device is powered on again.

4. The method of claim 1, further comprising:

when the balance causes the loudness of the first signal to be larger than the loudness of the second signal and the balance is set during a first program, maintaining validity of the setting of the balance even after completion of the first program; and when the balance causes the loudness of the second signal to be larger than the loudness of the first signal and the balance is set during the first program, invalidating the setting of the balance upon the completion of the first program.

5. An electronic device, comprising:

a hardware processor configured to:

receive an audio signal comprising voice and background sound other than voice;

receive a user's operation to set a loudness of the voice or the background sound; and set a balance between a first gain of the voice and a second gain of the background sound according to the user's operation;

a circuitry that separates the input audio signal into a first signal of the voice and a second signal of the background sound, amplifies the first signal according to the first gain, and amplifies the second signal according to the second gain, a first filter configured to correct a characteristic of the first signal with a first parameter and to output a corrected first signal, the first parameter determined based on the balance;

a second filter correct a characteristic of the second signal with a second parameter and to output a corrected second signal, the second parameter determined based on the balance; and a speaker that outputs the amplified first signal and the amplified second signal at least partially overlapping each other.

6. The electronic device of claim 5, wherein in response to a user's operation to increase the loudness of one of the first signal and the second signal, the hardware processor automatically sets the balance to reduce the loudness of the other one of the first signal and the second signal.

7. The electronic device of claim 5, wherein when the balance causes the loudness of the first signal to be larger than the loudness of the second signal, the hardware processor maintains validity of the setting of to the balance even if the electronic device for which the balance has been set is powered off and then powered on again, and when the balance causes the loudness of the second signal to be larger than the loudness of the first signal and the electronic device for which the balance has been set is powered off, the hardware processor invalidates the setting of the balance when the electronic device is powered on again.

8. The electronic device of claim 5, wherein when the balance causes the loudness of the first signal to be larger than the loudness of the second signal and the balance is set during a first program, the hardware processor maintains validity of the setting of the balance even after completion of the first program, and when the balance causes the loudness of the second signal to be larger than the loudness of the first signal and the balance is set during the first program, the hardware processor invalidates the setting of the balance upon the completion of the first program.

* * * * *